US009937987B2

(12) United States Patent
Dane et al.

(10) Patent No.: US 9,937,987 B2
(45) **Date of Patent: *Apr. 10, 2018**

(54) RIGID WING SAIL

(71) Applicant: SOLAR SAILOR PTY LTD, Sydney, New South Wales (AU)

(72) Inventors: Robert Dane, Sydney (AU); Ninan Mathew, Sydney (AU); Ian McBride, Sydney (AU)

(73) Assignee: SOLAR SAILOR PTY LTD, Sydney (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/341,899

(22) Filed: Nov. 2, 2016

(65) Prior Publication Data

US 2017/0066517 A1 Mar. 9, 2017

Related U.S. Application Data

(63) Continuation of application No. 14/432,691, filed as application No. PCT/AU2013/001153 on Oct. 8, 2013, now Pat. No. 9,527,563.

(30) Foreign Application Priority Data

Oct. 5, 2012 (AU) ..... 2012904360

(51) Int. Cl.

| | |
|---|---|
| ***B63H 9/04*** | (2006.01) |
| ***B63H 9/06*** | (2006.01) |
| ***B63H 9/08*** | (2006.01) |

(52) U.S. Cl.

CPC ..... *B63H 9/0607* (2013.01); *B63H 9/08* (2013.01); *B63H 2009/0635* (2013.01)

(58) Field of Classification Search

CPC ..... B63H 9/08; B63H 9/0607; B63H 9/06; B63B 2015/005; B63B 2015/0075; B63B 9/06; B63B 9/08

(Continued)

(56) References Cited

U.S. PATENT DOCUMENTS 4,505,217 A * 3/1985 Endo ..... B63H 9/0607 114/102.17
4,655,154 A * 4/1987 Leonard ..... B63B 15/02 114/91

(Continued)

FOREIGN PATENT DOCUMENTS

| | | |
|---|---|---|
| GB | 2234723 | 2/1991 |
| RU | 2148524 | 5/2000 |
| WO | 2005012079 | 2/2005 |

OTHER PUBLICATIONS

New Zealand Intellectual Property Office First Examination Report dated May 11, 2017 in NZ IP No. 726059.

(Continued)

*Primary Examiner* — Stephen P Avila
(74) *Attorney, Agent, or Firm* — Young Law Firm, P.C.

(57) ABSTRACT

The present invention relates broadly to a rigid wing (10) which in its preferred embodiment is a rigid wing sail fitted to a water-borne vessel. The rigid wing sail (10) comprises a pair of elongate rigid panels (12A) and (12B), and a hinge element designated generally as (14) coupled to the panels (12/B) to permit pivotal movement of the panels (12A/B) relative to one another. Each of the pair of panels such as (12A) includes an adjoining edge (16A) and an opposing lateral edge (18A). The hinge element (14) is coupled to the panels (12A/B) at the respective adjoining edges (16A/B) to form either: 1) a closed configuration of the wing (10) with lateral edges (18A/B) of respective panels (12A/B) positioned adjacent one another wherein the rigid wing sail (10)

(Continued)

is closed; or 2) an open configuration of the wing (10) with the lateral edges (18A/B) of the respective panels (12A/B) separated from one another wherein the rigid wing sail (10) is set at a variable camber.

5 Claims, 13 Drawing Sheets

(58) Field of Classification Search
USPC ..... 114/91, 102.15, 102.1
See application file for complete search history.

(56) References Cited

U.S. PATENT DOCUMENTS

| | | | | |
|---|---|---|---|---|
| 9,527,563 | B2 * | 12/2016 | Dane | B63H 9/0607 |
| 2007/0051292 | A1 * | 3/2007 | Kilbourn | B63B 35/00 114/311 |

OTHER PUBLICATIONS

New Zealand Intellectual Property Office First Examination Report dated Aug. 21, 2017 in NZ IP No. 726059.

* cited by examiner

RIGID WING SAIL

TECHNICAL FIELD

The present invention relates broadly to a rigid wing sail and relates particularly, although not exclusively, to a rigid wing sail for propelling a water-borne vessel.

BACKGROUND OF INVENTION

In designing water-borne vessels to be propelled by wind, custom sails are fabricated for specific sailing craft and configurations. The custom sails are fabricated from a flexible and pliable sail cloth and are typically referred to as soft sails. While designers and sail makers provide efficient designs for specific sailing craft, soft sails deform 'or luff' in strong winds when for example the sails are angled acutely into the wind when sailing upwind.

In addressing shortcomings in efficiency dependent on sail trim with soft sails, rigid wing sails have more recently been adopted, particularly in racing sail boats. The rigid wing sail can be pivoted or sleeved to adjust its angle of attack to the wind for the most efficient operation and propulsion of the water-home vessel to which it is mounted. The rigid wing sail is generally of a symmetrical section which allows it to develop lift on either side according to whether the vessel is on port or starboard tack. However, a rigid wing sail suffers from at least the following drawbacks:

(i) it cannot decrease its area by 'reefing' in strong winds or increase its area by 'unfurling' in light winds;
(ii) a rigid wingsail cannot change its camber;
(iii) even when depowered or 'feathered' and placed parallel to the direction of the wind, a rigid wing sail is difficult to control and depower.

SUMMARY OF INVENTION

According to the present invention there is provided a water-borne vessel comprising:

a hull and a deck connected to one another;

one or more elongate rigid panels adjoining one another to form a rigid wing sail which is curved in cross-section;

a mast coupled to the rigid wing sail substantially midway between its opposing edges, said mast mounted to the deck at a centreline of the hull for tilting of said rigid wing sail relative to the deck between:

i) a lowered position where the curved rigid wing sail wraps about the deck along the centreline of the hull; and ii) a raised position where the curved rigid wing sail is exposed for wind propulsion of the water-borne vessel.

Preferably said one or more elongate rigid panels comprises of a pair of elongate rigid panels together defining an elongate bore within which the mast is received. More preferably each of the pair of rigid panels is one continuous piece of rigid material.

Preferably the mast is mounted to a joint mechanism which permits tilting of the rigid wing sail between the lowered and the raised positions.

Preferably the water-borne vessel also comprises solar panels mounted or applied to an exposed surface of the elongate rigid panels.

Preferably the rigid wing is adapted to fit to a vehicle. More preferably the vehicle is a water-borne vessel.

BRIEF DESCRIPTION OF DRAWINGS

In order to achieve a better understanding of the nature of the present invention a preferred embodiment of a rigid wing sail will now be described, by way of example only, with reference to the accompanying drawings in which.

DETAILED DESCRIPTION

As shown in FIGS. 1A to 1I there is a rigid wing 10 which in its preferred embodiment is a rigid wing sail fitted to a water-borne vessel (not shown). The rigid wing sail 10 comprises a pair of elongate panels 12A and 12B, and a hinge element designated generally as 14 coupled to the panels 12A/B to permit pivotal movement of the panels 12A/B relative to one another. Each of the pair of panels such as 12A includes an adjoining edge 16A and an opposing lateral edge 18A. The pair of panels 12A/B in this embodiment form a mirror image about a centreline defined by the hinge element 14 The hinge element 14 is coupled to the panels 12A/B at their respective adjoining edges 16A/B to form either:

1. a closed configuration of the wing 10 with the lateral edges 18A/B of respective panels 12A/B positioned adjacent one another wherein the rigid wing sail 10 is closed; or
2. an open configuration of the wing 10 with the lateral edges 18A/B of the respective panels 12A/B separated from one another wherein the rigid wing sail 10 is set at a variable camber.

Figure 1A:
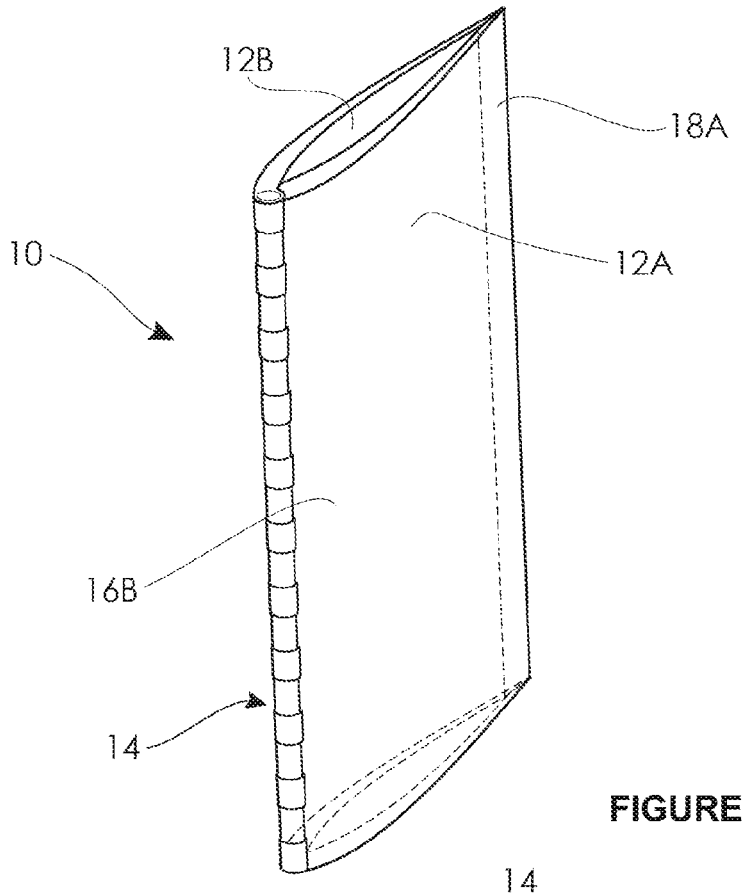
FIGS. 1A to 1I are various views of a rigid wing sail according to an embodiment of the invention shown in different configurations.
Figure 1B:
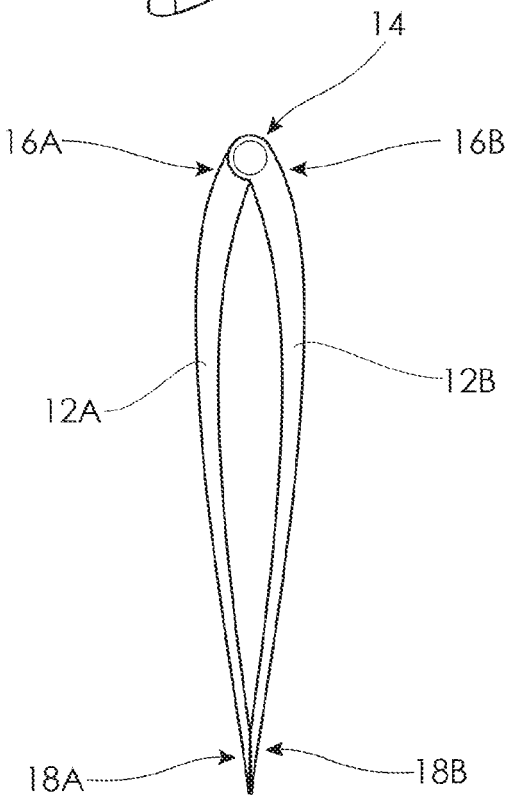
Figure 1C:
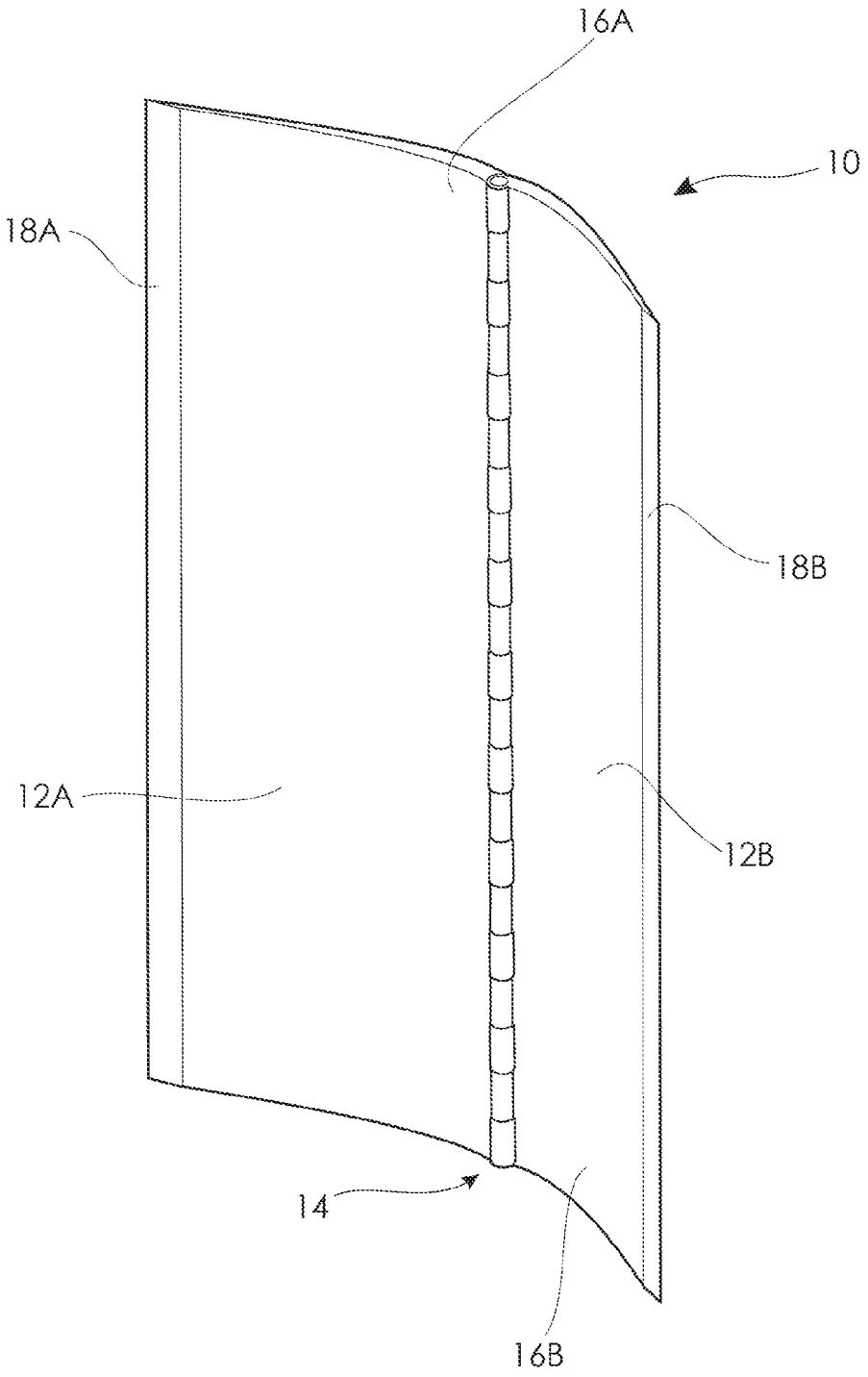
Figure 1D:
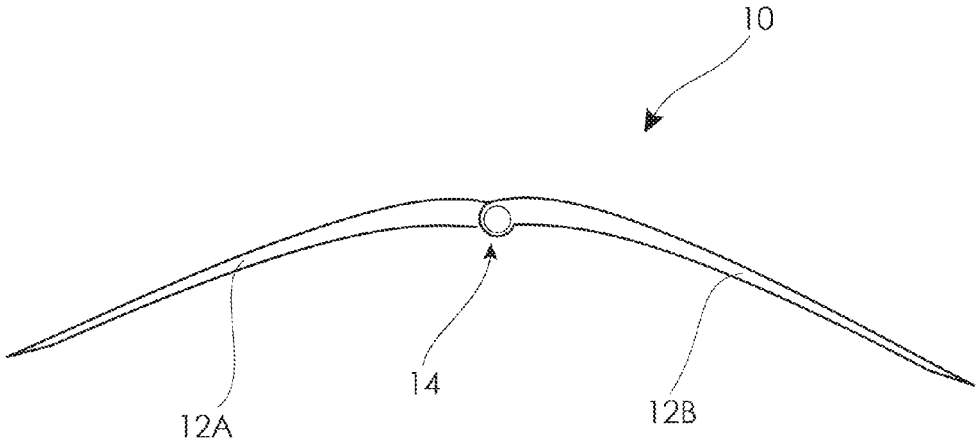
Figure 1E:
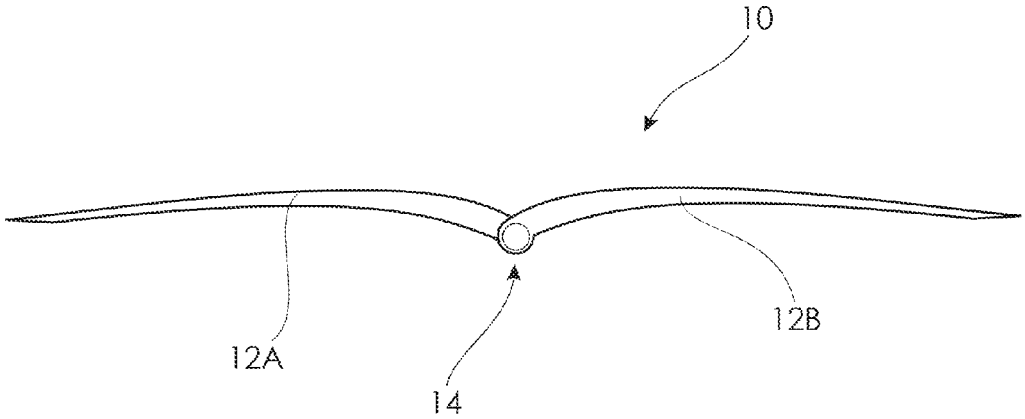
Figure 1F:
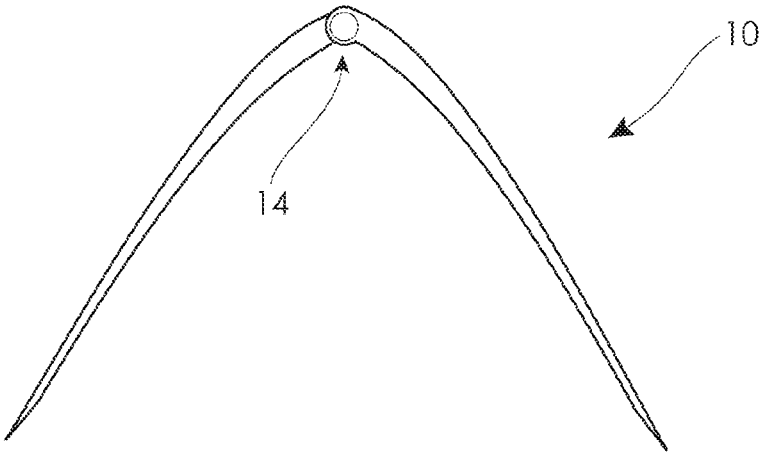
Figure 1G:
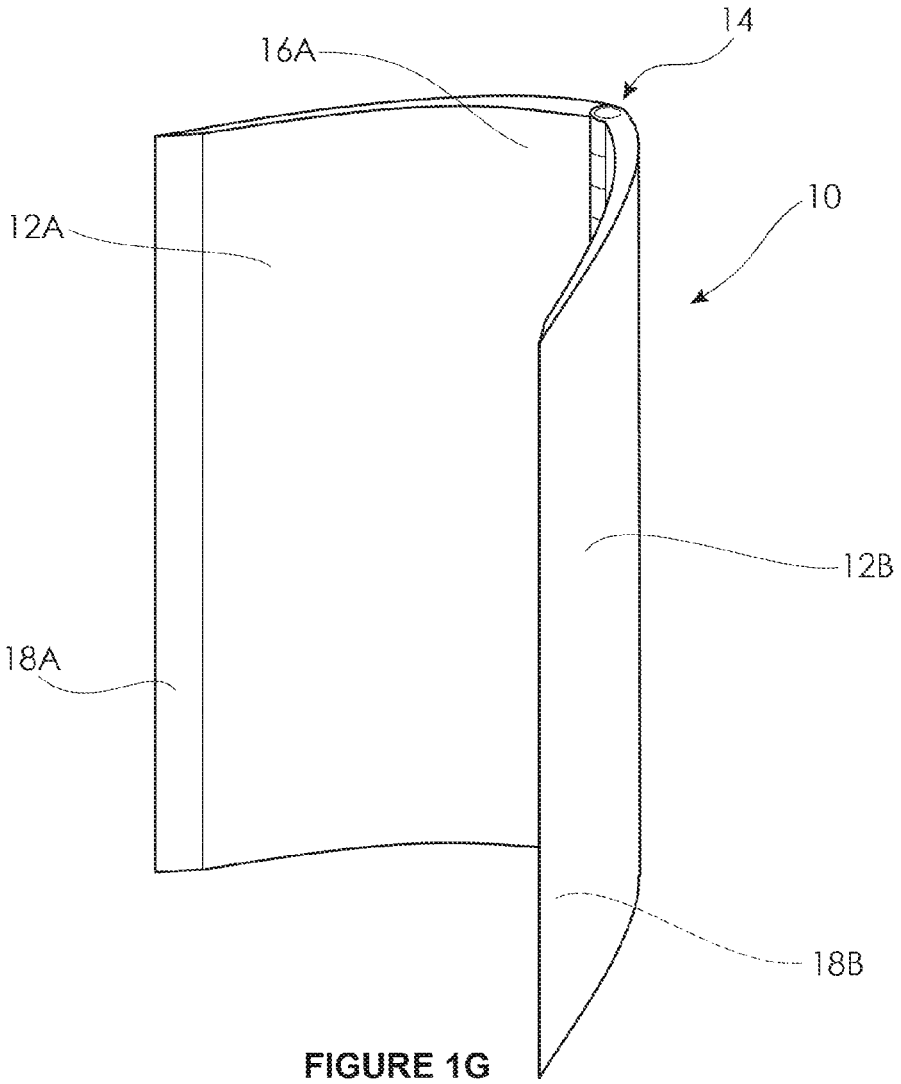
Figure 1H:
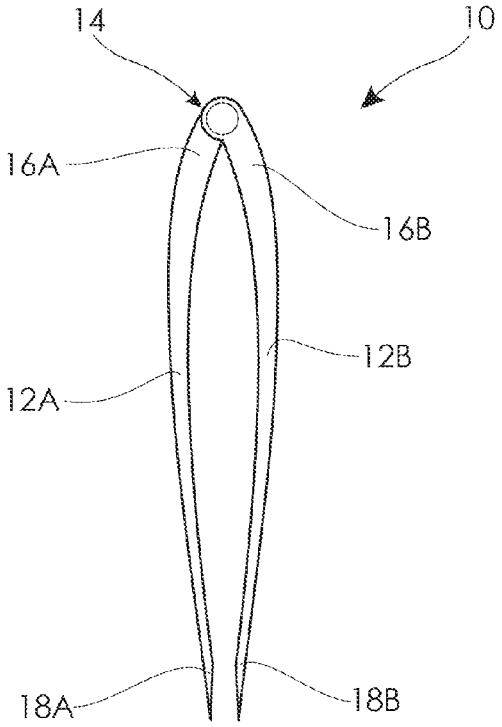
Figure 1I:
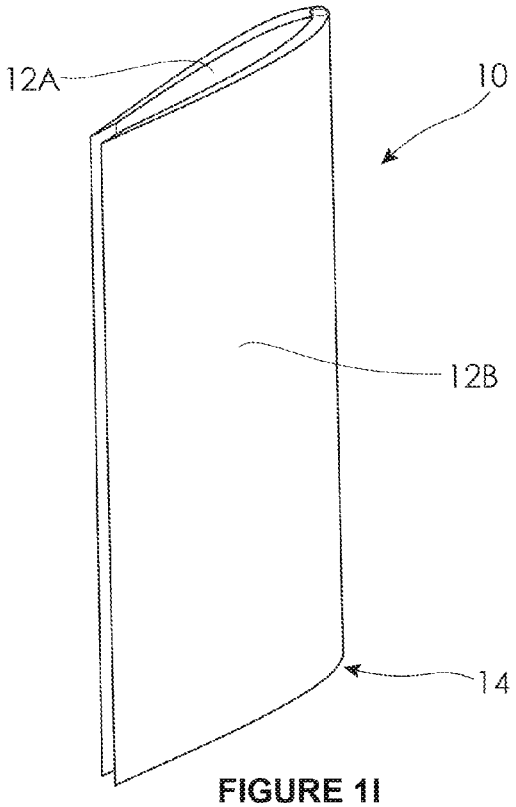

The rigid wing 10 in its closed configuration is for example shown in FIGS. 1A and 1B whereas FIGS. 1C to 1G show the rigid wing 10 in various open configurations at variable cambers. FIGS. 1H and 1I show the rigid wing 10 substantially closed where the thickness of the aerofoil section is changed from that of the rigid wing 10 in its closed configuration in FIGS. 1A and 1B.

In this preferred embodiment each of the elongate panels of 12A/B is fabricated in one continuous piece. The one-piece panel such as 12A is in cross-section curved and of an asymmetric shape. This asymmetric shape is designed so that the pair of panels 12A/B in the closed configuration form a symmetric wing having an aerofoil shape. Each of the one-piece panels is fabricated from a rigid material such as a metal, for example steel or aluminium.

Figure 2:
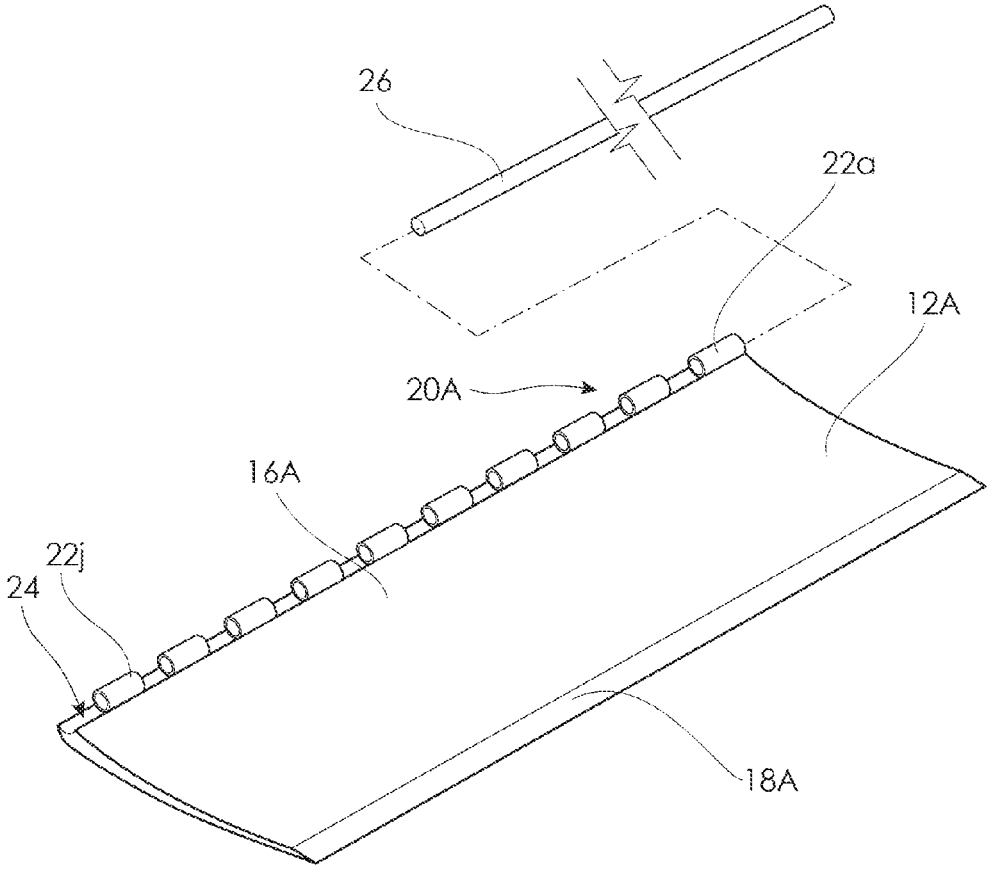
FIG. 2 is a perspective view of one of the pair of elongate panels from the rigid wing of the preferred embodiment.

As shown in FIG. 2 the hinge element 14 is in the form of a piano-type hinge 20A connected to respective adjoining edges 16A of the panels such as 12A. The piano-type hinge 20A includes a plurality of equally spaced tubular segments such as 22*a* to 22*j* aligned coaxially with one another. The tubular segments 22*a* to 22*j* of the elongate panel 12A are designed to mesh with corresponding tubular segments 22*a*' with 22*j*' of the other elongate panel 12B. The meshed tubular segments 22*a* to 22*j* and 22*a*' to 22*j*' define an elongate bore 24. The hinge element 14 of this embodiment includes a shaft 26 which is received within the elongate bore 24. The pair of elongate panels 12A/B are thus permitted to pivot about the shaft 26 relative to one another for movement into or toward the open or closed configurations.

Figure 3A:
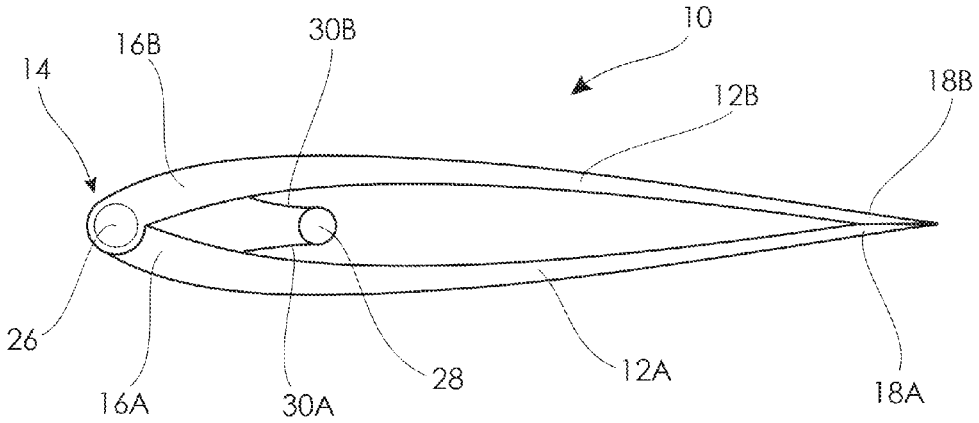
FIGS. 3A and 3B are different views of another embodiment of a rigid wing according to the invention shown in a closed configuration.
Figure 3B:
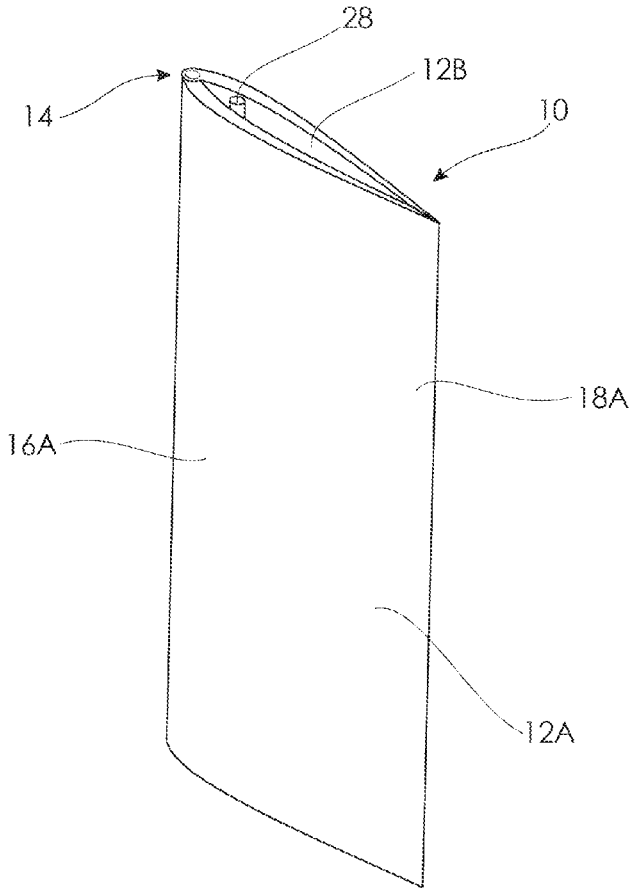

FIGS. 3A and 3B depict another embodiment of a rigid wing sail 10 which is similar to the preceding embodiment but with a mast 28 located within the rigid wing 10 in its closed configuration. For ease of reference and in order to avoid repetition like components of this embodiment have been designated with the same reference numeral as the preceding and preferred embodiment. The rigid wing 10 includes one or more pairs of struts such as 30A and 30B longitudinally spaced along the mast 28. The struts 30A and 30B are of an equal and fixed length and connected to the respective panels 12A and 12B at a position relative to the shaft 26 of the hinge element 14 so that the geometry lends itself to opening and closure of the panels 12A/B relative to one another. The struts 30A/B pivotally connect opposing ends to the mast 28 and the corresponding wing 12A or 12B respectively. With the mast 28 spaced back from the leading edge of the rigid wing sail 10 it is "balanced" when in its closed and open configurations.

Figure 4A:
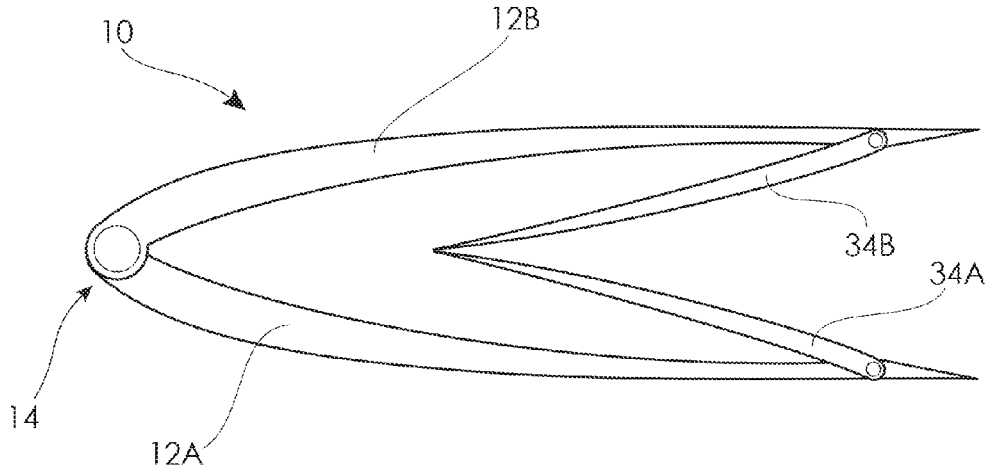
FIGS. 4A to 4C are different views of a rigid wing according to yet another embodiment of the invention shown in various configurations.
Figure 4B:
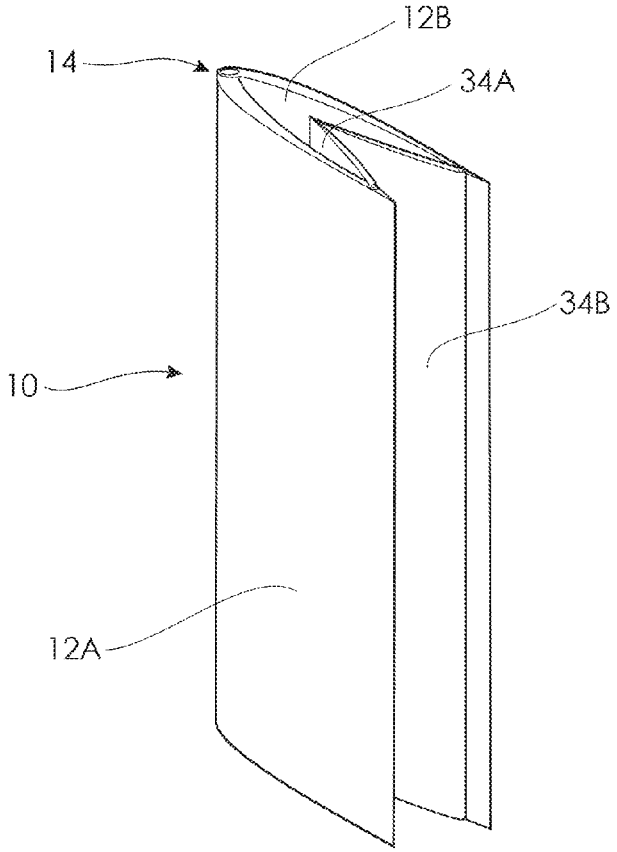
Figure 4C:
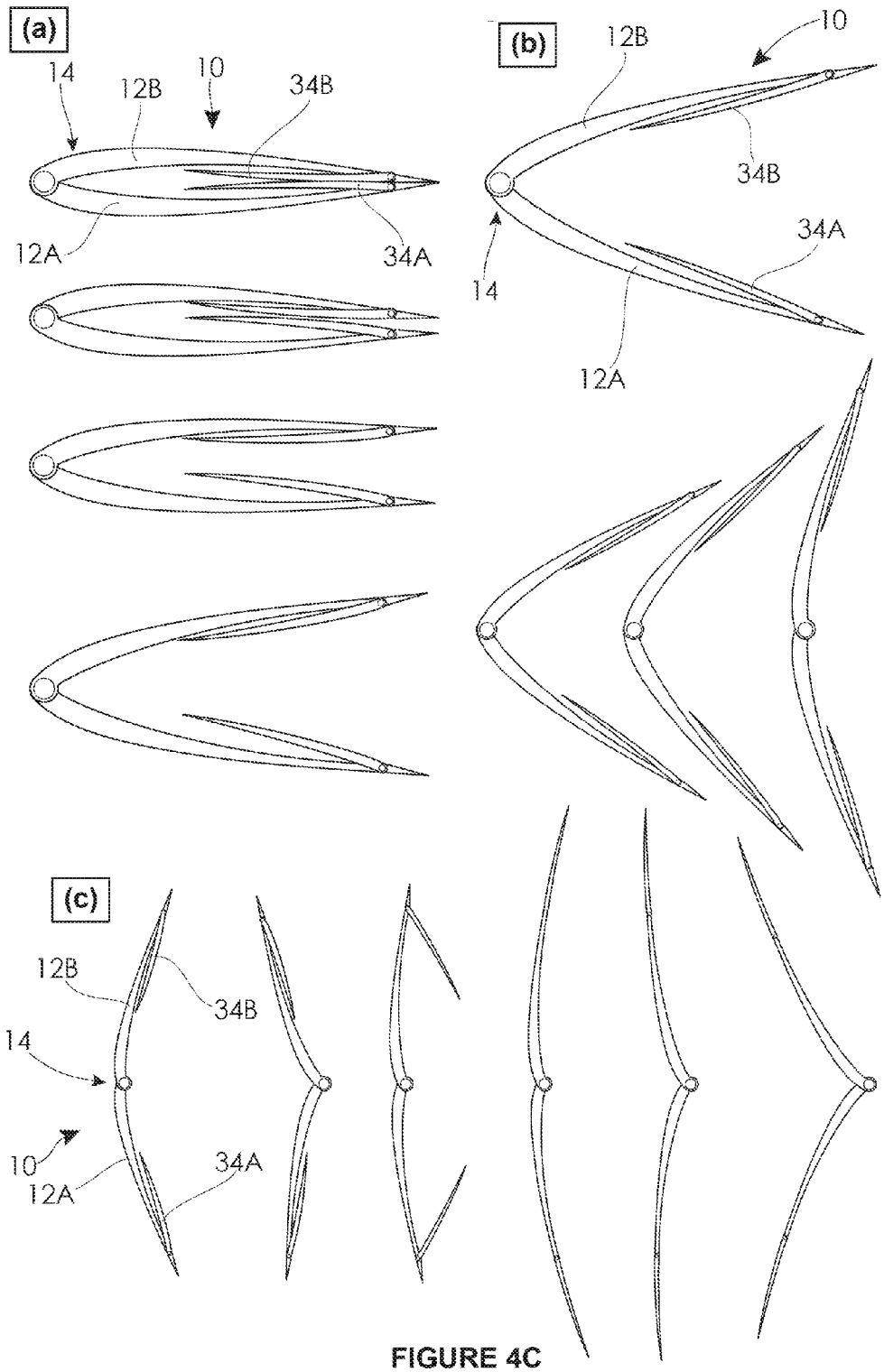

FIGS. 4A to 4C illustrate a further embodiment of a rigid wing 10 according to the present invention. This variation on the rigid wing 10 is essentially the same as the preceding embodiments except for the inclusion of additional panels 34A and 34B. These additional panels 34A/B are pivotally connected to respective of the primary elongate panels 12A/B. The additional or secondary panels 34A/B collapse inwardly of the rigid wing 10 in its closed configuration. In order to avoid repetition and for ease of reference like components of this embodiment have been indicated with the same reference numeral as the preceding embodiments.

The secondary panels 34A/B are of a one-piece rigid material. The secondary panels are each curved so that in the open configuration the rigid wing 10 forms a continuation of the primary panels 12A/B. FIG. 4C illustrates gradual opening and closure of the rigid wing 10 of this further embodiment. These secondary panels are driven by and controlled by a joint mechanism at the base of the wing sail.

Figure 5A:
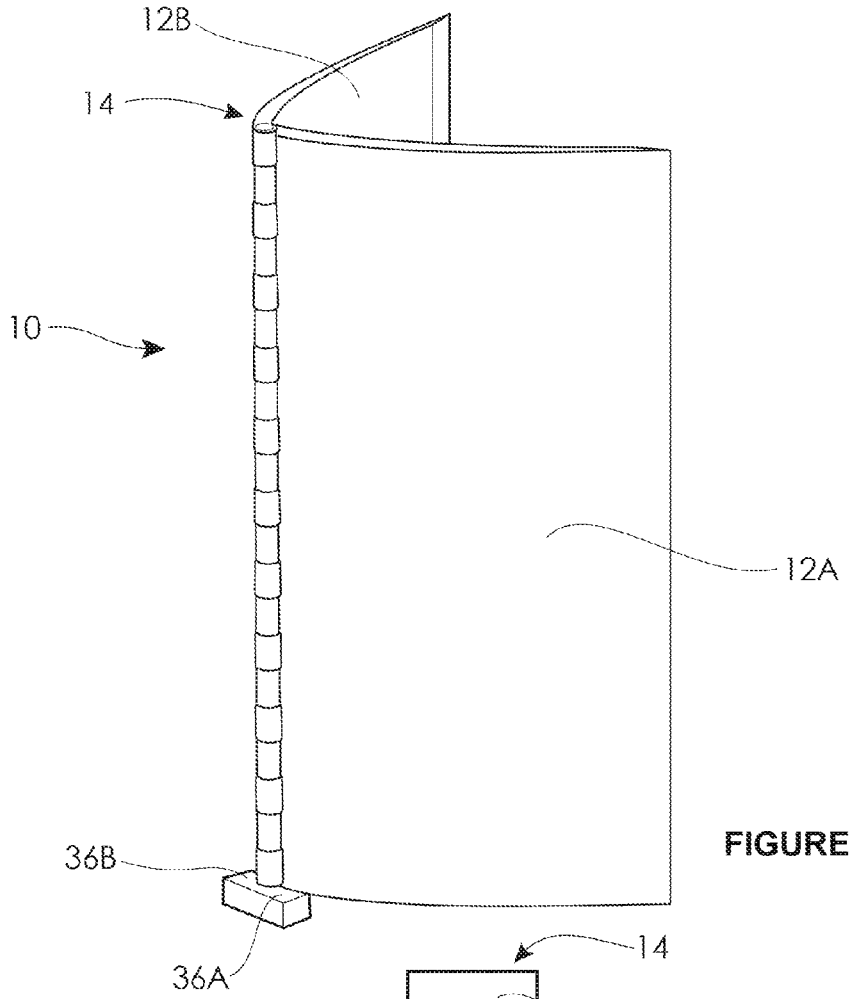
FIGS. 5A and 5B are different views of a rigid wing according to a further embodiment of the invention shown in a partially closed configuration.
Figure 5B:
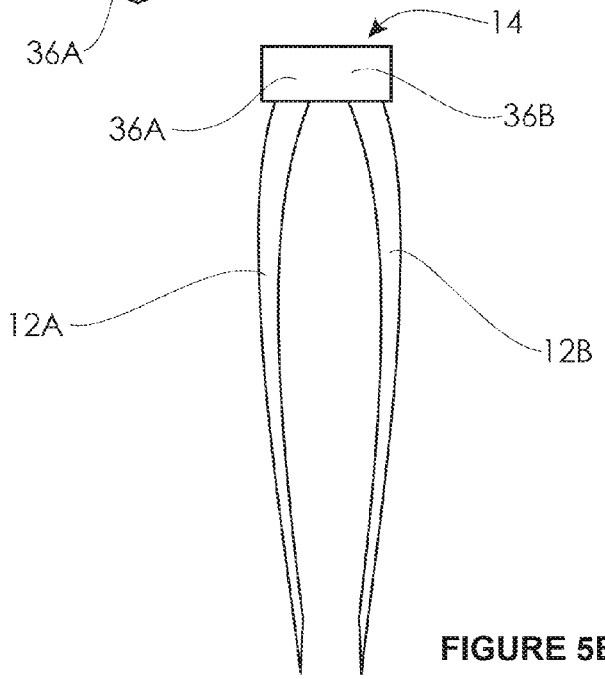

FIGS. 5A and 5B illustrate yet another embodiment of the rigid wing according to the present invention. This variation of the rigid wing includes a pair of shafts 36A and 36B coupled to respective of the elongate panels 12A and 12B. The shafts 36A/B are in this alternative embodiment in the form of a pair of masts about which the respective panels 12A/B pivot for opening and closure. For ease of reference like components of this embodiment have been indicated with the same reference numeral as the preceding embodiments.

Figure 6:
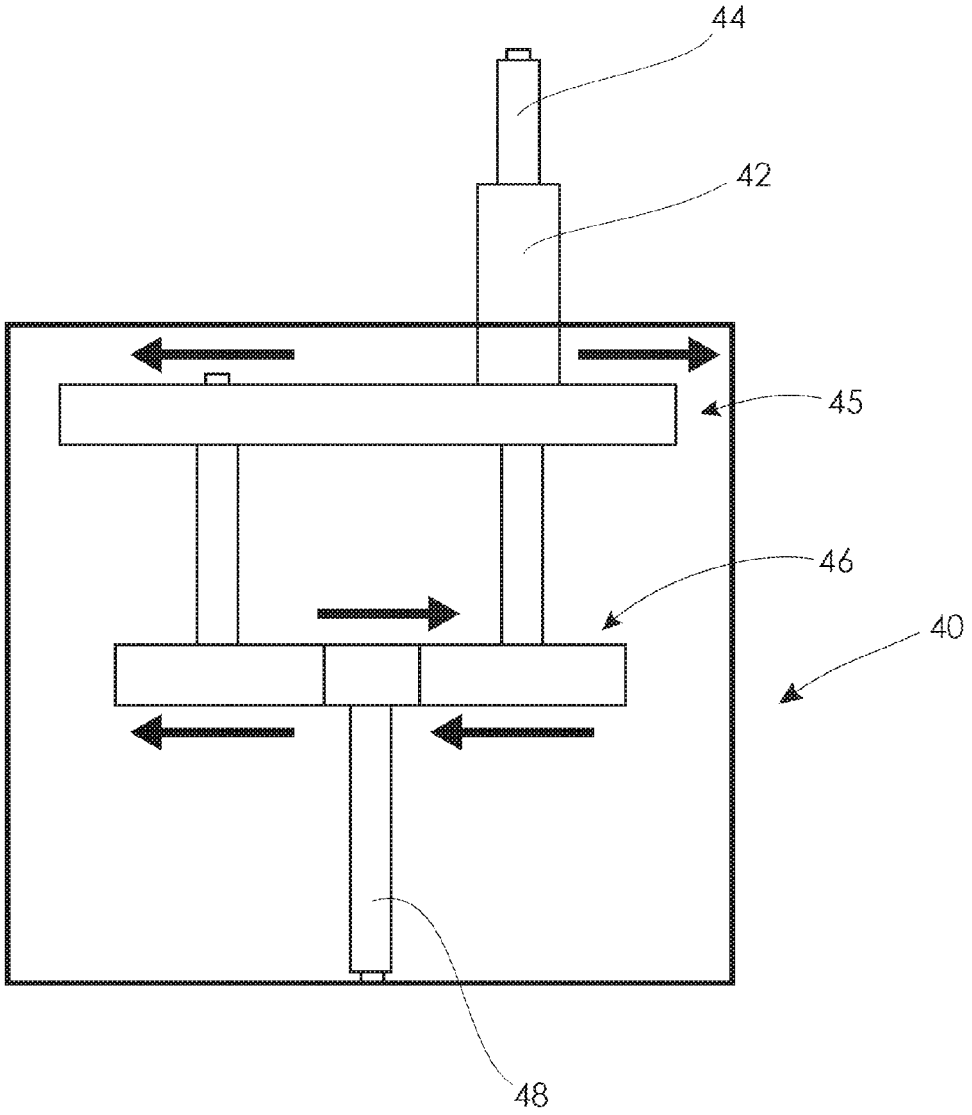
FIG. 6 is schematic illustration of hinge actuating means for pivotal movement of the rigid wing of any one of the previous embodiments, other pair of the rigid panel.

FIG. 6 depicts an embodiment of hinge actuating means for driving pivotal movement of the panels such as 12A and 12B. The hinge actuating means designated as 40 is operatively coupled to the hinge element 14 for pivotal movement of the panels 12A/B relative to one another. For the rigid wing sail 10 of FIGS. 1 to 4, the hinge actuating means 40 includes a pair of coaxial drive shafts 42 and 44 arranged to drive pivotal movement of respective primary panels 12A and 12B. In this embodiment the drive shafts 42 and 44 may be directly fixed to either the panels 12A/B or the respective tubular segments 22*a* and 22*a*'. Alternatively, the drive shafts 42 and 44 may be indirectly coupled to the elongate panels 12A/B, for example via intermediate gears (not shown). In this example the actuating means 40 includes a gear train designated as 45 and 46 driven by an electric motor (not shown) coupled to drive shaft 48.

In the alternative embodiment of FIG. 5 the drive shafts 42 and 44 are axially spaced from one another to align or cooperate independently with the respective shafts or masts 36A and 36B. In either case the hinge actuating means 40 includes the drive motor coupled to both the drive shafts 42 and 44 via an appropriate gear arrangement which provides rotation of the shafts 42 and 44 in opposite directions. Alternatively the hinge actuating means may include a pair of drive motors coupled to respective of the drive shafts 42 and 44.

Figure 7A:
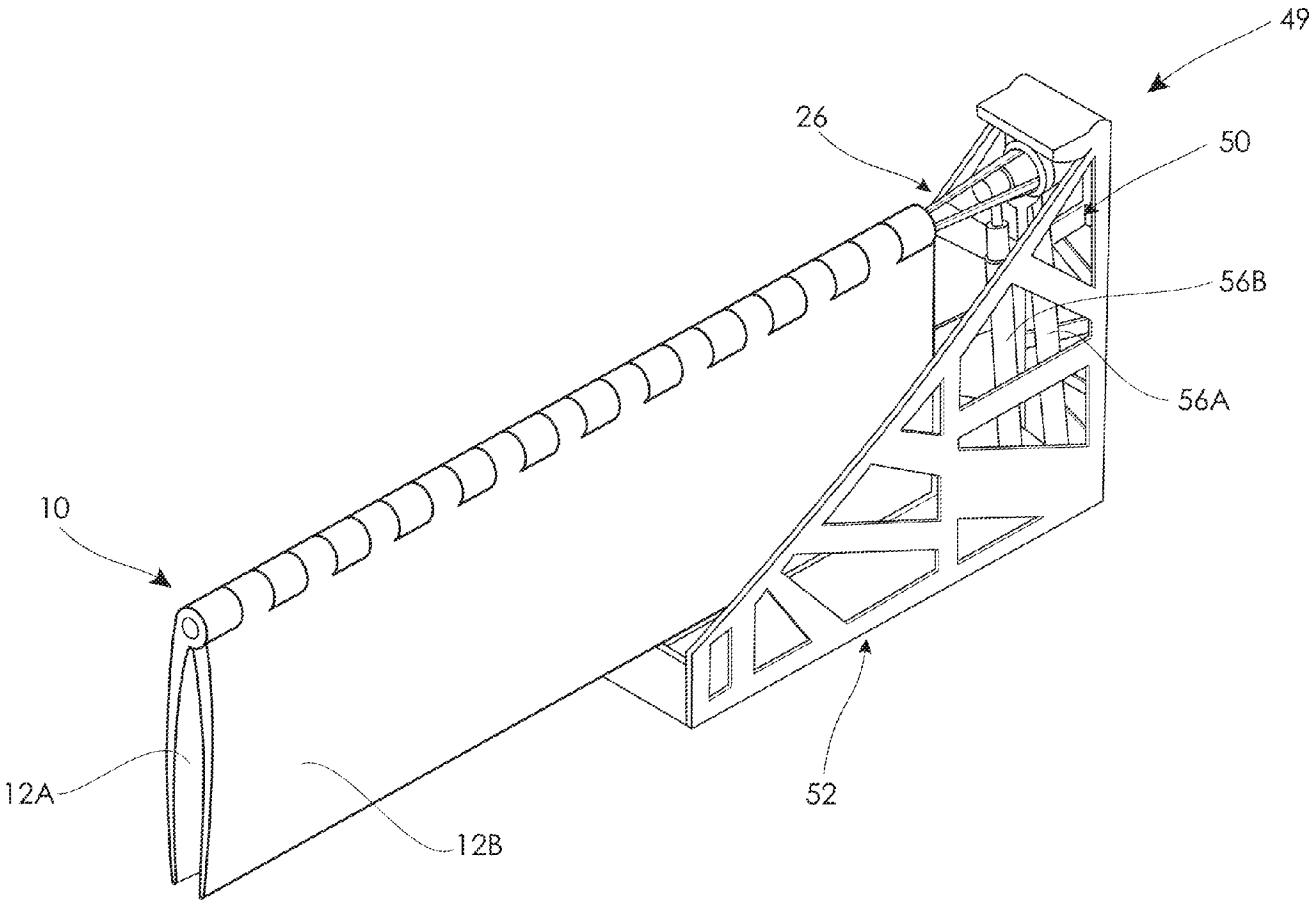
FIGS. 7A to 7C are isometric views of the rigid wing of the preferred embodiment mounted to a joint mechanism for raising and lower of the rigid wing of any one of the previous embodiments and various methods for stowing.
Figure 7B:
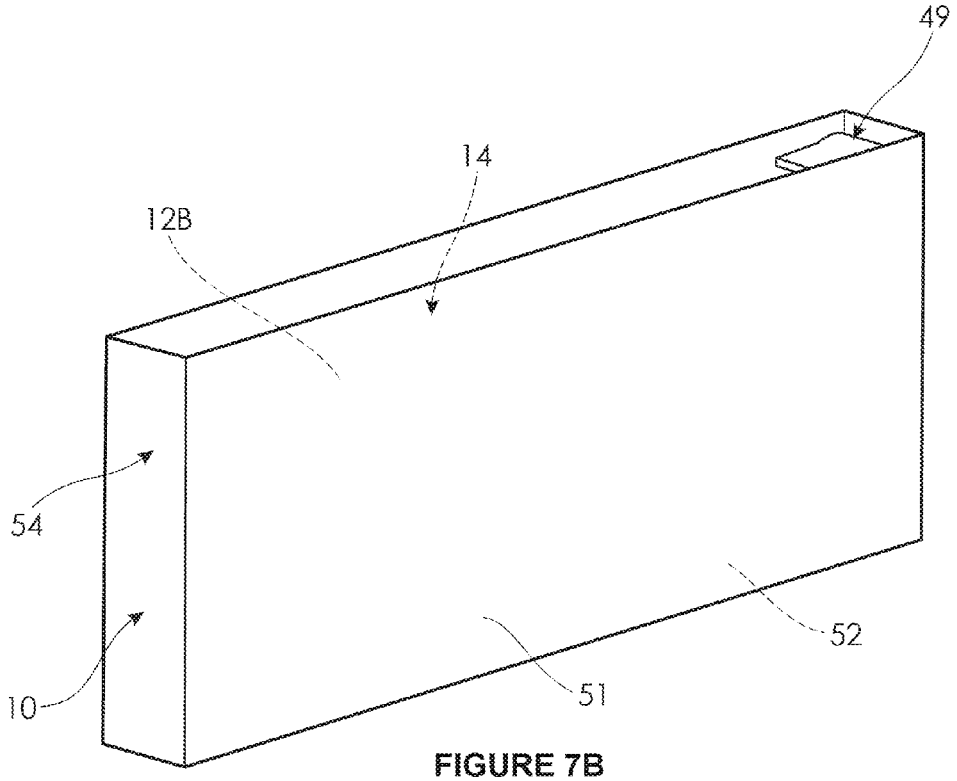
Figure 7C:
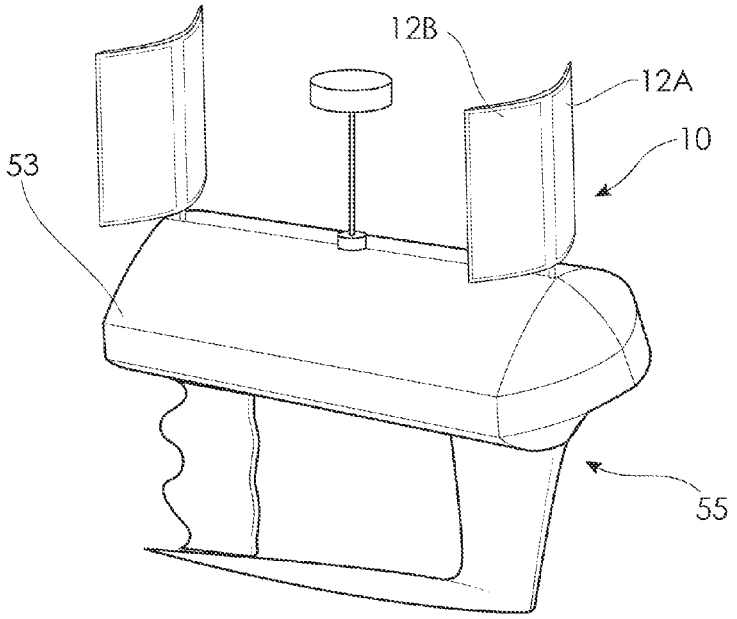

FIGS. 7A to 7C show one example of a joint mechanism 49 for raising and lowering of the rigid wing sail such as 10. When the mast 28 is lowered the rigid panels can be:

a) closed and folded one side or another on a deck (see FIG. 7A);
b) closed and stowed into a superstructure 51 and hull of a vessel (see FIG. 7B);
c) opened and 'wrapped' around a superstructure 53 of a vessel 55 designed to be of a complementary shape (see FIG. 7C);
d) opened and stored horizontally as an 'awning' (not shown).

In this embodiment the rigid wing 10 includes the mast 26 mounted to a tilting platform 50. The tilting platform 50 pivotally connects to a pedestal 52 which is designed to for example mount to the deck of a water-borne vessel (not shown). The rigid wing 10 in its closed configuration may as shown in FIG. 7B also be housed within a cassette or compartment 54 located above or below deck when the rigid wing 10 is lowered.

The tilting platform 50 is in this embodiment tilted via one or more hydraulic cylinders such as 56A and 56B connected at opposing ends to a base of the pedestal 52 and the tilting platform 50. The tilting platform 50 is thus pivoted relative to the pedestal 52 for raising or lower of the rigid wing 10 preferably in its closed configuration. Alternatively the pedestal 52 mounted above deck the rigid wing 10 may be lowered in its open configuration wherein it provides shade.

The rigid wing sail 10 may additionally be clad or partly covered in solar panels (not shown), preferably on the convex surfaces on one or both of the elongate panels such as 12A and 12B. The solar panels may take the form of solar photovoltaic (PV) panels such as those rolled out in strip form across the rigid wing 10. The solar panels may be used to generate electricity which is harnessed to assist in driving or supporting ancillary equipment of the vessel (not shown).

Now that several preferred embodiments of the invention have been described it will be apparent to those skilled in the art that the rigid wing has at least the following advantages:

1. The rigid wing can be reduced in area or effectively reefed by pivotal movement of the panels into the closed configuration;
2. The rigid wing can be reconfigured to effectively capture the wind by shifting the relative disposition of the panels to effectively reshape/alter the camber of the wing;
3. The rigid wing lends itself to mounting arrangement which permit:

i slewing movement to change the angle of the rigid wing relative to the apparent wind for effective operation; and/or ii. tilting of the rigid wing for raising or lowering, for example to effectively stow on or within the vessel to which it is mounted;

4. The rigid wing in its preferred form includes a pair of elongate panels each of a one-piece construction which lends itself to relatively simple and inexpensive fabrication.

Those skilled in the art will appreciate that the invention described herein is susceptible to variations and modifications other than those specially described. For example, the hinge actuating means may depart from the mechanical arrangement described and, for example, be driven by hydraulics or pneumatics. The elongate panels of the rigid wing need not necessarily be shaped according to the preferred embodiments to provide an aerofoil section and could in their simplest form be limited to planar panels. The materials of construction may also depart from that described provided the rigid wing and panels are fabricated predominantly from a rigid material. The rigid wing is not to be limited to its application on water-borne vessels but may extend to other applications such as airships, spaceships, landships, and iceships All such variations and modifications are to be considered within the scope of the present invention the nature of which is to be determined from the foregoing description.

The invention claimed is:

1. A water-borne vessel comprising:

an elongate rigid panel that forms a rigid wing sail that is curved in cross-section to define a predetermined shape;

a hull and a deck connected to one another, the deck having a shape that is complementary to the predetermined shape of the curved rigid wing sail;

a mast coupled to the rigid wing sail substantially midway between its opposing edges, said mast being mounted to the deck at a centreline of the hull and configured for tilting of said curved rigid wing sail relative to the deck between:

i) a lowered position in which the predetermined shape of the curved rigid wing sail enables the curved rigid wing to wrap about the complementary shape of the deck along the centreline of the hull; and ii) a raised position where the curved rigid wing sail is exposed for wind propulsion of the water-borne vessel.

2. A water-borne vessel as defined in claim 1, wherein said elongate rigid panel defines an elongate bore within which the mast is received.

3. A water-borne vessel as defined in claim 1, wherein the mast is mounted to a joint mechanism that is configured to enable tilting of the curved rigid wing sail between the lowered and the raised positions.

4. A water-borne vessel as defined in claim 1, further comprising solar panels mounted or applied to an exposed surface of the elongate rigid panel.

5. A water-borne vessel as defined in claim 2, wherein the elongate rigid panel is one continuous piece of rigid material.

* * * * *